US007726489B2

(12) United States Patent
Li

(10) Patent No.: US 7,726,489 B2
(45) Date of Patent: Jun. 1, 2010

(54) PACKAGING BOX

(75) Inventor: Ming Li, Guangdong (CN)

(73) Assignees: Premier Image Technology (China) Ltd., Foshan, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 16 days.

(21) Appl. No.: 12/125,883

(22) Filed: May 22, 2008

(65) Prior Publication Data

US 2009/0173659 A1 Jul. 9, 2009

(30) Foreign Application Priority Data

Jan. 4, 2008 (CN) ..... 2008 1 0300024

(51) Int. Cl.
*B65D 85/30* (2006.01)

(52) U.S. Cl. ..... 206/588; 206/586; 206/592; 229/167

(58) Field of Classification Search ..... 206/588, 206/587, 586, 722, 592, 521, 320; 229/167, 229/120.17
See application file for complete search history.

(56) References Cited

U.S. PATENT DOCUMENTS 4,426,034 A * 1/1984 Flanagan ..... 229/125.19
5,145,070 A * 9/1992 Pallett et al. ..... 206/521
5,372,259 A * 12/1994 Suzuki et al. ..... 206/586
5,540,330 A * 7/1996 Lo Duca ..... 206/446
5,871,147 A * 2/1999 Smith et al. ..... 229/167
6,640,971 B2 * 11/2003 Acevedo ..... 206/320
6,675,970 B1 * 1/2004 Nemoto ..... 206/521
7,097,043 B2 * 8/2006 Hsu ..... 206/784
7,303,071 B2 * 12/2007 Saito ..... 206/320

FOREIGN PATENT DOCUMENTS

CN 1291161 A 4/2001

* cited by examiner

*Primary Examiner*—Ehud Gartenberg
*Assistant Examiner*—Ernesto A Grano
(74) *Attorney, Agent, or Firm*—Zhigang Ma

(57) ABSTRACT

A packaging box includes a top plate, a bottom plate, two side plates, a front plate, and a rear plate. The packaging box has two shock absorbers extending from the bottom end of the two side plates respectively. Each of the shock absorbers includes a lower surface, a first side surface, an upper surface, and a second side surface extending from the bottom end of the corresponding side plate in sequence. The second side surface is formed opposite to the first side surface and is adjacent to the corresponding side plate.

14 Claims, 4 Drawing Sheets

PACKAGING BOX

TECHNICAL FIELD

The present invention relates to a packaging box and, particularly, to a packaging box configured for providing a supporting and protecting structure to a portable electronic device.

DESCRIPTION OF RELATED ART

Shock absorbers are quite often provided in a packaging box configured for receiving a portable electronic device to protect the portable electronic device from shock damage during transportation. It is quite common to stuff the packaging box as shock absorbers like foam-rubber, paperboard, and plastic materials. The shock absorbers can keep the portable device from colliding with other items inside the same packaging box. The shock absorbers also prevent collisions between the portable device and the packaging box. However, in most of the cases, these shock absorbers are usually fabricated separately from the packaging box, thereby the packaging box tends to be complicated, time-consuming, and expensive.

What is needed, therefore, is a packaging box having integrally formed shock absorbers.

SUMMARY

In accordance with a present embodiment, a packaging box includes a top plate, a bottom plate, two side plates, a front plate, and a rear plate. The packaging box has two shock absorbers extending from the bottom end of the two side plates respectively. Each of the shock absorbers includes a lower surface, a first side surface, an upper surface, and a second side surface extending from the bottom end of the corresponding side plate in sequence. The second side surface is formed opposite to the first side surface and is adjacent to the corresponding side plate.

BRIEF DESCRIPTION OF THE DRAWING

Many aspects of the present packaging box can be better understood with reference to the following drawings. The components in the drawing are not necessarily drawn to scale, the emphasis instead being placed upon clearly illustrating the principles of the present packaging box. Moreover, in the drawings, like reference numerals designate corresponding parts throughout the several views.

DETAILED DESCRIPTION OF THE EMBODIMENT

Embodiments will now be described in detail below, with reference to the drawings.

Figure 1:
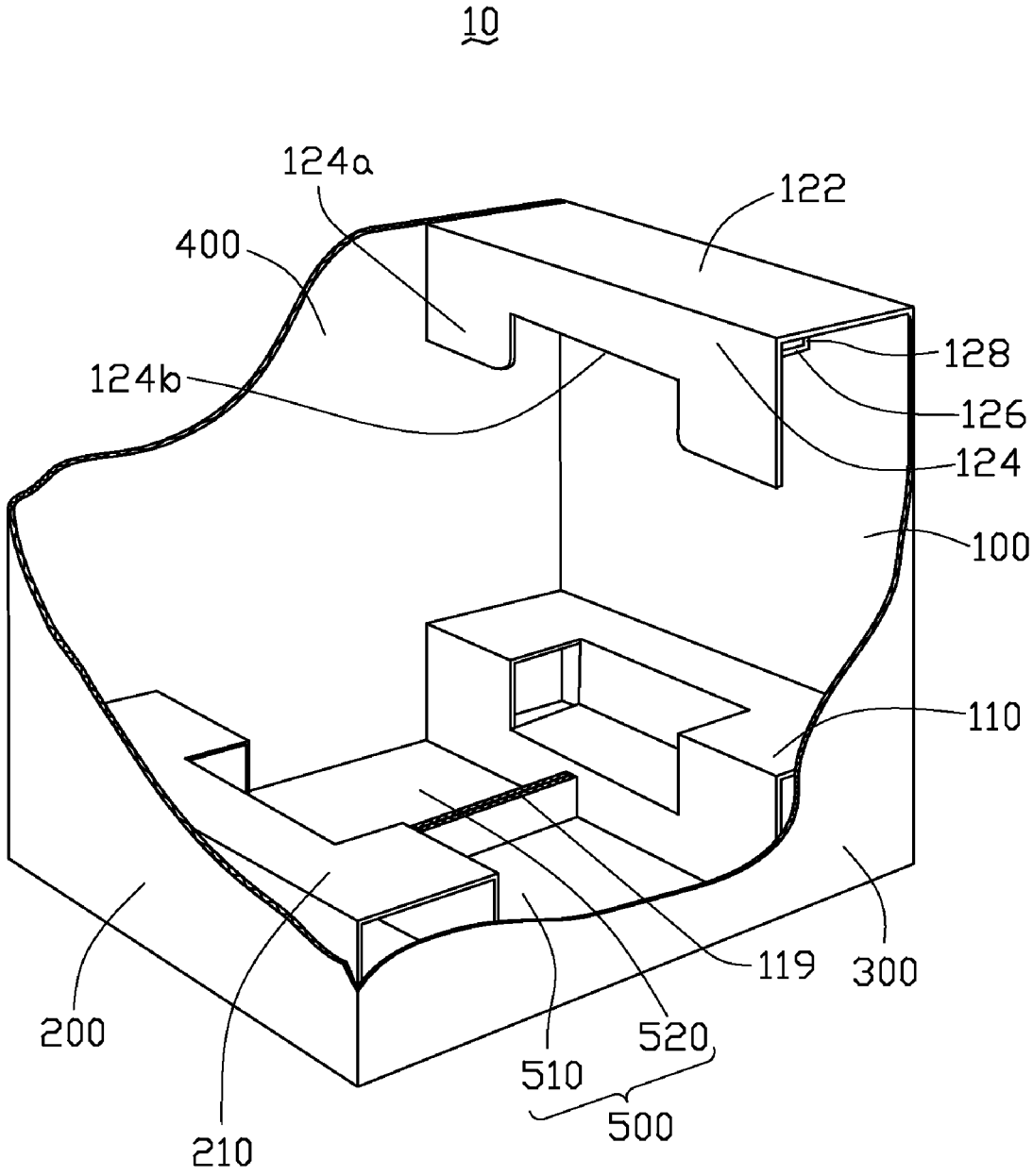
FIG. 1 is a schematic, cut-away perspective view of a folded packaging box in accordance with an exemplary embodiment of the present invention.
Figure 2:
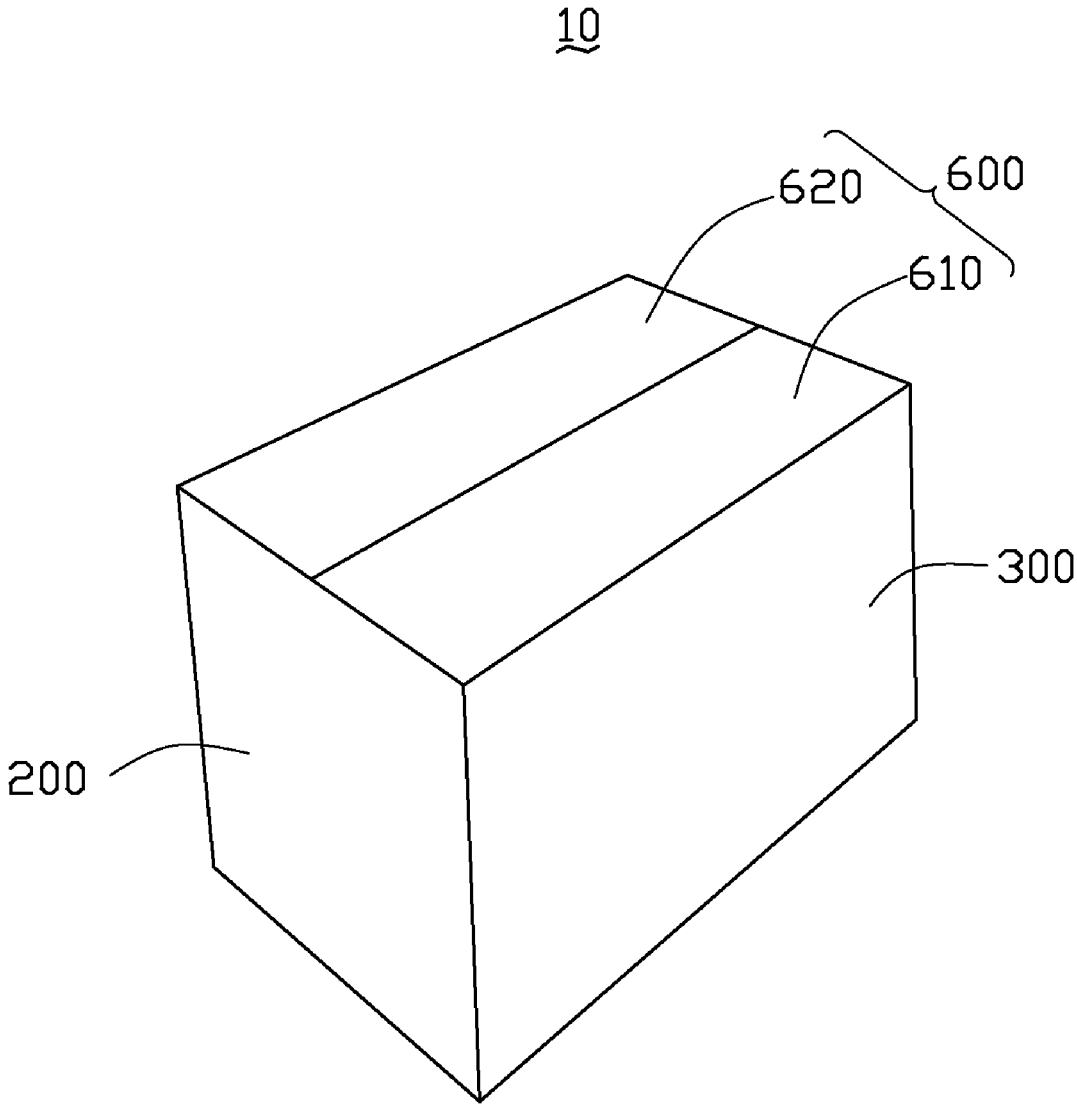
FIG. 2 is a isometric view of FIG. 1, showing the folded packaging box.

Referring to FIG. 1 and FIG. 2, a packaging box 10 for a portable device, in accordance with an exemplary embodiment is shown. The packaging box 10 can be made of corrugated paperboard, recycled paper, art paper, and so on. In this embodiment, the packaging box 10 is made of corrugated paperboard and has an integrative configuration.

The packaging box 10 includes a side plate 100, a side plate 200, a front plate 300, a rear plate 400, a bottom plate 500, and a top plate 600. The bottom plate 500 is divided into a first section 510 and a second section 520. The top plate 600 is divided into a first part 610 and a second part 620.

Figure 3:
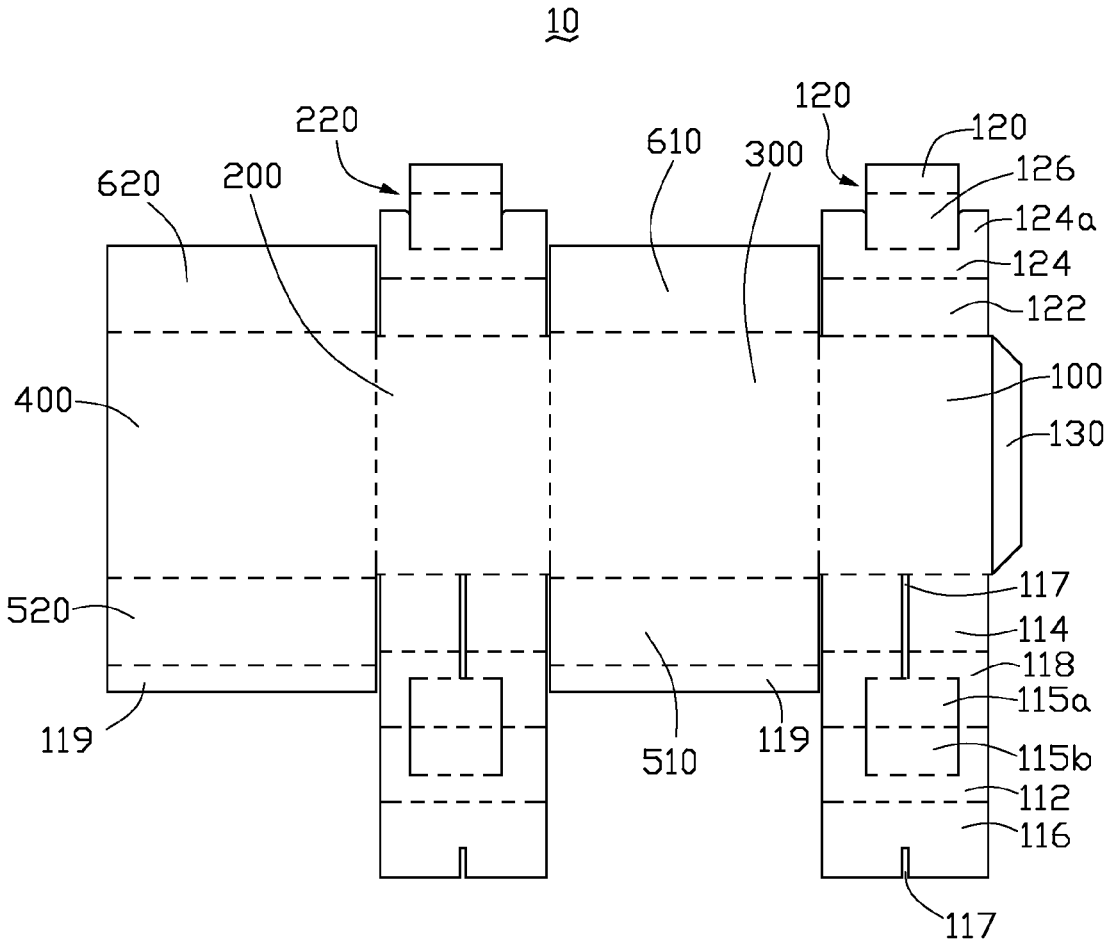
FIG. 3 is a top plan view of the unfolded packaging box of FIG. 2.

Referring to FIG. 3, an unfolded view of the packaging box 10 is shown. The side plate 100, the front plate 300, the side plate 200, and the rear plate 400 are fixedly connected in sequence. The first section 510 of the bottom plate 500 and the first part 610 of the top plate 600 extend from a bottom end and a top end of the front plate 300 respectively. The second section 520 of the bottom plate 500 and the second part 620 of the top plate 600 extend from a bottom end and a top end of the rear plate 400 respectively.

The packaging box 10 includes two shock absorbers 110, 210 formed at the bottom of the packaging box 10. The shock absorbers 110, 210 are extended from the bottom end of the corresponding side plates 100, 200. The structure of the shock absorber 210 is the same as the shock absorber 110, so only the structure of the shock absorber 110 is described below.

Figure 4:
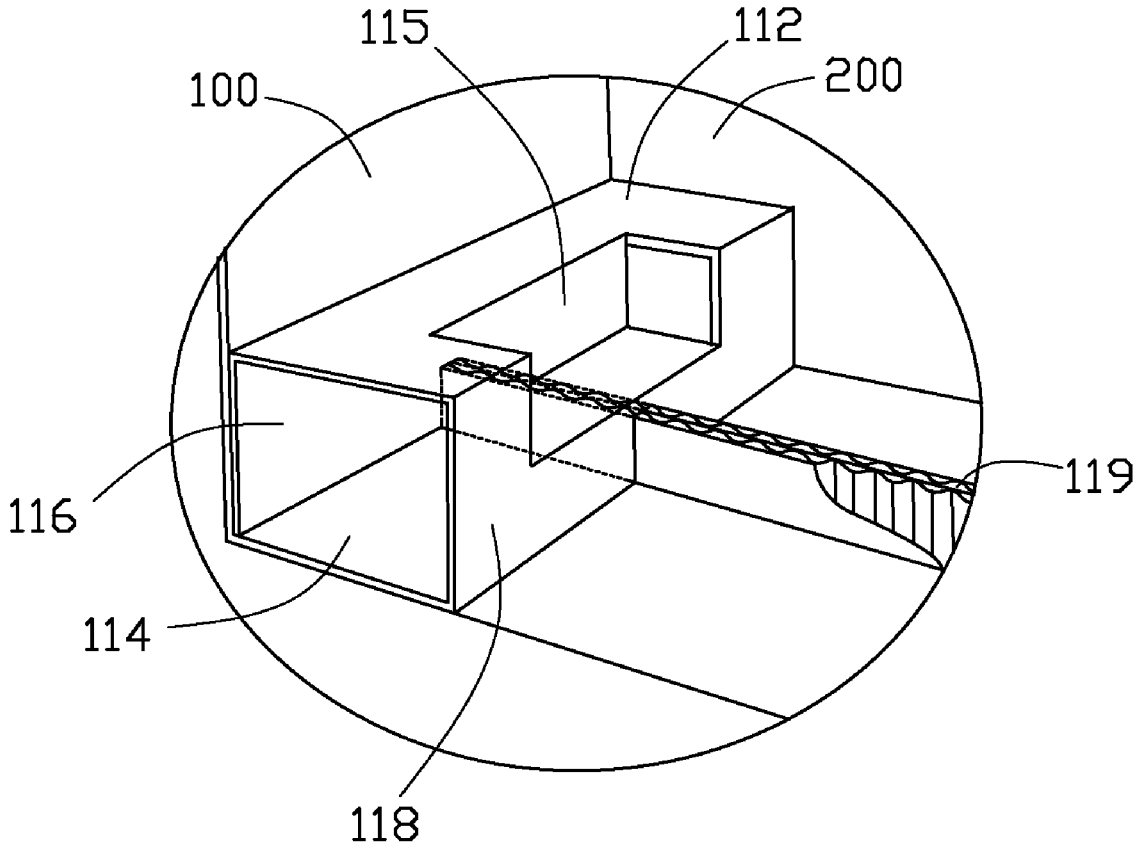
FIG. 4 is an isometric view of a shock absorber of the packaging box of FIG. 1.

Referring to FIG. 4, the shock absorber 110 includes an upper surface 112, a lower surface 114 extending from the bottom of the side plate 100 and opposite to the upper surface 112, a side surface 116 adjacent to the side plate 100, and a side surface 118 opposite to the side surface 116. The lower surface 114, the side surface 118, the upper surface 112, the side surface 116 are fixedly connected in sequence. The shock absorber 110 defines a recess 115 for holding a product, such as a portable electronic device. As shown in FIG. 3, the recess 115 has a bottom surface 115*a* bending from a part of the side surface 118, and a side surface 115*b* bending from a part of the upper surface 112

The shock absorber 110 also defines an embedded slot 117 extending from the lower surface 114 of the shock absorber 110 to the bottom surface 115*a* of the recess 115. The embedded slot 117 runs through the side surface 116 and 118 which are located between the bottom surface 115*a* of the recess 115 and the lower surface 114 of the shock absorber 110. At least one strengthening plate 119 is inserted into the embedded slot 117 for strengthening the shock absorber 110. Each strengthening plate 119 extends from the shock absorber 110 to the shock absorber 210 with two ends thereof inserted into the embedded slots 117 of the two shock absorbers 110 and 210 for strengthening the two shock absorbers 110 and 210. In the present embodiment, there are two strengthening plates 119, but are not limited to. One of them extends from an end of the first section 510 opposite to the front plate 300, and the other extends from an end of the second section 520 opposite to the rear plate 400. Preferably, ridges of the corrugated paper forming the strengthening plates 119 are perpendicular to the bottom surface 115*a* of the recess 115.

The packaging box 10 also includes two holding parts 120 and 220 opposite to the shock absorbers 110 and 210 respectively. The holding parts 120 and 220 are configured for aiding the shock absorbers 110 and 210 in securing items inside the packaging box 10. The holding parts 120 and 220 are formed by extending from the top end of the side plates 100 and 200 respectively. The structure of the holding part 220 is of the same as the holding part 120, so only the structure of the holding part 120 is described below.

The holding part 120 includes an upper surface 122, a side surface 124, a lower surface 126, and a side surface 128 opposite to the side surface 124, which extend from the top end of the side plate 100 in sequence. The widths of the lower surface 126 and the side surface 128 are smaller than the width of the side surface 124. The side surface 124 has two protrusions 124*a* at the same side of the side surface 124 and located at two side of the lower surface 126. The two protrusions 124*a* extend toward the shock absorber 110 and define an opening 124*b* opposite to the shock absorber 110.

In order to connect the side plate 100 to the rear plate 400, in the present embodiment, the side plate 100 also includes a connecting portion 130 at an end thereof opposite to the front plate 300. The connecting portion 130 is configured for securing to the rear plate 400 by glue or other matter with similar function. It is understood that the connecting portion can also be located at an end of the rear plate 400 near the side plate 100.

The packaging box 10 has two shock absorbers 110 and 210 integrally formed with the side plate 100 and 200 of the packaging box 10, and can be assembled easily. Furthermore, because the packaging box 10 of the present invention is formed by folding a single piece of material, the cost of the packaging box 10 can be reduced.

While certain embodiments have been described and exemplified above, various other embodiments will be apparent to those skilled in the art from the foregoing disclosure. The present invention is not limited to the particular embodiments described and exemplified but is capable of considerable variation and modification without departure from the scope of the appended claims.

What is claimed is:

1. A packaging box comprising:

a top plate;

a bottom plate opposite to the top plate;

two side plates;

a front plate;

a rear plate opposite to the front plate;

two shock absorbers formed by extending from bottom ends of the two side plates respectively, each of the shock absorbers comprising a lower surface, a first side surface, an upper surface, and a second side surface formed opposite to the first side surface and adjacent to the corresponding side plate extending from the bottom end of the corresponding side plate in sequence, the shock absorbers each defining a recess for holding a product, and the recess comprising a bottom surface formed by bending a part of the first side surface and a side surface formed by bending a part of the upper surface, the absorbers each further defining an embedded slot extending from the lower surface of the shock absorber to the bottom surface of the recess, the embedded slot running through the first side surface and the second side surface; and at least one strengthening plate, each strengthening plate having two ends thereof inserted into the embedded slots of the two shock absorbers for strengthening the two shock absorbers.

2. The packaging box as claimed in claim 1, further comprising one strengthening plate extending from an end of the first section far away from the front plate or from an end of the second section far away from the rear plate, wherein the bottom plate comprises a first section and a second section extending from bottom ends of the front plate and the rear plate respectively.

3. The packaging box as claimed in claim 1, comprising two strengthening plates extending from an end of the first section far away from the front plate and an end of the second section far away from the rear plate respectively, wherein the bottom plate comprises a first section and a second section extending from bottom ends of the front plate and the rear plate respectively.

4. The packaging box as claimed in claim 1, wherein the packaging box is made of a material selected from a group consisting of corrugated paperboard, recycled paper, and art paper.

5. The packaging box as claimed in claim 1, wherein the packaging box is made of a corrugated paperboard with ridges thereof perpendicular to the bottom surface of the recess.

6. The packaging box as claimed in claim 1, wherein the packaging box comprises two holding parts opposite to the two shock absorbers respectively for aiding the two shock absorbers in securing product inside the packaging box.

7. The packaging box as claimed in claim 1, wherein the two side plates of the packaging box comprise a first side plate and a second side plate; the first side plates, the front plate, the second side plate, and the rear plate are fixedly connected in sequence; and the first side surface comprises a connecting portion for securing to the rear plate.

8. A packaging box comprising:

a top plate;

a bottom plate opposite to the top plate;

two side plates;

a front plate;

a rear plate opposite to the front plate;

two shock absorbers formed by extending from bottom ends of the two side plates respectively, each of the shock absorbers comprising a lower surface, a first side surface, an upper surface, and a second side surface formed opposite to the first side surface and adjacent to the corresponding side plate extending from the bottom end of the corresponding side plate in sequence, the absorbers each defining an embedded slot running through the first side surface, the second side surface, and the lower surface; and at least one strengthening plate, each strengthening plate having two ends thereof inserted into the embedded slots of the two shock absorbers for strengthening the two shock absorbers.

9. The packaging box as claimed in claim 8, wherein the bottom plate comprises a first section and a second section extending from bottom ends of the front plate and the rear plate respectively, and the packaging box comprises one strengthening plate extending from an end of the first section far away from the front plate or from an end of the second section far away from the rear plate.

10. The packaging box as claimed in claim 8, comprising two strengthening plates extends from an end of the first section far away from the front plate and an end of the second section far away from the rear plate respectively, wherein the bottom plate comprises a first section and a second section extending from bottom ends of the front plate and the rear plate respectively.

11. The packaging box as claimed in claim 8, wherein the packaging box is made of a material selected from a group consisting of corrugated paperboard, recycled paper, and art paper.

12. The packaging box as claimed in claim 8, wherein the packaging box is made of a corrugated paperboard with ridges thereof perpendicular to the bottom surface of the recess.

13. The packaging box as claimed in claim 8, further comprising two holding parts opposite to the two shock absorbers respectively for aiding the two shock absorbers in securing product inside the packaging box.

14. The packaging box as claimed in claim 8, wherein the two side plates of the packaging box comprise a first side plate and a second side plate; the first side plates, the front plate, the second side plate, and the rear plate are fixedly connected in sequence; and the first side surface comprises a connecting portion for securing to the rear plate.

* * * * *